United States Patent [19]

DePriester

[11] Patent Number: 4,501,329

[45] Date of Patent: Feb. 26, 1985

[54] NON-ABRASIVE PARTICULATE MATERIAL FOR PERMEABILITY ALTERATION IN SUBSURFACE FORMATIONS

[75] Inventor: Coral L. DePriester, Moraga, Calif.

[73] Assignee: Chevron Research Company, San Francisco, Calif.

[21] Appl. No.: 485,921

[22] Filed: Apr. 18, 1983

[51] Int. Cl.[3] ..... E21B 33/138

[52] U.S. Cl. ..... 166/292; 166/309

[58] Field of Search ..... 166/292, 272, 303, 309; 175/72; 252/8.5 LC

[56] References Cited

U.S. PATENT DOCUMENTS

| | | | |
|---|---|---|---|
| 2,241,255 | 5/1941 | Garrison | 175/72 X |
| 2,379,516 | 7/1945 | Garrison | 166/292 |
| 2,683,690 | 7/1954 | Armentrout | 175/72 UX |
| 2,812,161 | 11/1957 | Mayhew | 166/292 X |
| 3,221,825 | 12/1965 | Henderson | 175/72 |
| 3,249,158 | 5/1966 | Kieschnick, Jr. et al. | 166/292 |
| 3,603,398 | 9/1971 | Hutchison et al. | 175/72 X |
| 3,713,489 | 1/1973 | Fast et al. | 166/292 |
| 4,093,310 | 6/1978 | Terry | 166/292 X |

OTHER PUBLICATIONS

Hampel, Clifford, A. et al., *Glossary of Chemical Terms*, Second Edition, 1982, p. 52.

*Primary Examiner*—George A. Suchfield

*Attorney, Agent, or Firm*—Edward J. Keeling; J. A. Buchanan, Jr.

[57] ABSTRACT

An improved particulate material is disclosed for use in a method for altering the permeability of a gravity override or relatively high permeability path through a subsurface earth formation resulting from fluid injection into the subsurface formation. The method includes adding selectively sized, finely divided, amorphous non-abrasive particulate material to a fluid and injecting the fluid into the gravity override or relatively high permeability path to deposit the particulate material thus altering the permeability in the override, or relatively high permeability path. The particulate material may include graphite, carbon black, clay suspensions, quartz, or other minerals reduced in size range to behave as non-abrasive amorphous material which will present a non-abrasive characteristic in injection wells and if the particulate material is produced with formation fluids from the treated formation.

3 Claims, No Drawings

NON-ABRASIVE PARTICULATE MATERIAL FOR PERMEABILITY ALTERATION IN SUBSURFACE FORMATIONS

BACKGROUND OF THE INVENTION

1. Field of the Invention

This invention relates to a process for producing petroleum crude from a permeable earth formation and more particularly to a material and a method for treating a subsurface permeable formation containing petroleum crude to increase petroleum crude production while preventing abrasive damage to well equipment caused by movement of materials previously used in treating subsurface permeable formations.

2. Prior Art

It has been known to inject water, gas and steam into an earth formation containing petroleum crude to increase the mobility of the crude and cause it to move to a producing location. In some field procedures the same well alternately is used for both injection and for crude production (known as huff-and-puff in a steaming operation) and in other field procedures separate injection and production walls spaced from each other through the petroleum containing formation are used. A variety of injection procedures using a variety of injection materials have been proposed most of which have the objective of increasing the volume of production of the petroleum crude at the producing well.

In the particular case of steam injection into an injection well with the objective of moving crude to a producing well, it has been observed that the efficiency of the sweep of crude from the formation is diminished, sometimes to zero, when injection steam breaks through into the producing well. This condition is known as gravity override. Hot water which separates from the injected steam tends to sweep through the bottom portions of the heated interval while the steam vapor tends to override the hot water, because of differences in densities of the two fluids. As the hot water flows through the reservoir, heat is transferred to the rock and reservoir fluids. This results in a temperature transition from the hot water bank to cooler water ahead of the bank. In practice, this means an ordinary waterflood precedes the warm and hot water banks which results in reduced sweep efficiency and a gradual increase in residual oil saturation with distance from the injector. Because of the unfavorable viscosity ratio the efficiency of this waterflood will be poor. However, good recovery efficiency with steam in the upper portion of the heated interval will result in significant reductions in residual oil saturations. These differences in oil saturations will adversely affect the naturally-poor relative permeability ratio of steam and water. As a result, injected steam will tend to prematurely breakthrough into the offset producing wells without sweeping the entire heated interval. If this condition is permitted to continue, the production of reservoir fluids can drop to zero and only steam and water will be produced at the producing wells.

In steam flooding, the rate of steam injection is initially high so as to minimize heat losses to the cap and base rock with time. Frequently, this procedure results in the development of a highly permeable and relatively oil-free channel between injector and producer. Many times this channel develops near the top of the oil bearing rock. In this case, much of the injected heat is conducted to the cap rock as a heat loss, rather than being conducted to oil bearing sand where the heat is needed. In addition, the steam cannot displace oil efficiently since little oil is left in the channel. Consequently, neither the gas drive from the steam vapor nor the convective heat transfer mechanisms work efficiently. This is why much lower oil recovery results when a steam flood breaks through into the producing well.

Further, while some graphic illustrations of steam profiles between injection wells and producing wells represent that steam and hot fluids start all along the injection well, rise toward the top of the producing interval in the direction of the producing well and drop down near the producing well, it is now a common belief that such a profile is inaccurate. More than likely, once the steam has risen through the producing interval it will not drop down into the producing well when steam breakthrough occurs. This condition has been shown to exist by temperature profiles along a producing well. Such a condition further reduces the sweep efficiency of such a steam injection method.

Somewhat similarly, injected water as gas may pass more rapidly through relatively more permeable strata to producing wells reducing displacement of crude in less permeable strata to lower values or zero.

It has been suggested to inject a blocking barrier into the formation to reduce the loss of steam, water or gas through the breakthrough path. One such barrier is a foam as suggested in U.S. Pat. No. 3,412,793 issued to R. B. Needham on Nov. 26, 1968 for Plugging High Permeability Earth Strata. The highly permeable formation is temporarily plugged with a foam by introduction of steam and a foaming agent into the formation whereby a foam having steam as its gaseous phase is formed and, upon condensation of the steam due to loss of heat, the foam collapses. A similar procedure is shown in U.S. Pat. No. 4,086,964 issued to R. E. Dilgren et al. on May 2, 1979 for Steam-Channel-Expanding Steam Foam Drive. That patent suggests the addition of a noncondensible gas to the foam and injection into the steam channel to provide foam and a relatively high pressure gradient within the channel. Neither of these patents are believed to provide the relatively permanent solution to the gravity override breakthrough problems as is disclosed in the present application.

In copending application Ser. No. 289,550, now abandoned, by Stanley O. Hutchinson, for Foam and Particulate Material With Steam for Permeability Alteration in Subsurface formation, assigned to the same assignee as the present application, a method is proposed to alter the gravity override path within the formation by carrying into the formation particulate materials which will alter the permeability of the override path and thus encourage the flow of injection steam or hot fluids into the formations where reservoir fluids remain. The intention of the injection procedures is to recognize gravity override breakthrough and to then inject into that breakthrough path materials which will alter the permeability therein and then return to the injection procedure to reestablish communication between the injection fluids and the reservoir where the desired reservoir fluids remain. The particulate material is carried into the permeability override path with a low velocity fluid thus accomplishing the desired permeability alteration without damage to the well bore liner and without "bridging" in the formation.

It is suspected that the fine particulate materials that have previously been proposed for altering the permeability of the formation can be carried with produced and injected fluids into the production well and through the producing equipment. It is known that fine particulate material has returned to the injection well in a huff-and-puff operation and has damaged producing equipment by abrasion. Characteristicly, the steam-stimulated well requires pumping to bring the produced fluids to the earth's surface. The movement of the fine particulate materials with the fluids may result in abrasion damage to the pumping equipment if abrasive particulates are used.

The object of the present invention is the placement of particulate material in a subsurface earth formation in a manner to alter the permeability of the formation. The particulate material selected for the present invention is a material from the group of materials which will provide a non-abrasive characteristic for the previously injected particulate materials produced through the formation thus avoiding abrasive damage to subsurface and wellhead equipment used both in injection and producing wells.

A further object is the use of non-abrasive finely divided amorphous particulate material as an addition to injected gas, liquid or vapor for altering the permeability of a subsurface formation where a higher permeability passageway has been naturally or artificially created.

Further objects and features of the present invention will be readily apparent to those skilled in the art from the following specification describing preferred embodiment.

DETAILED SPECIFICATION

It has been demonstrated that particulate material can be carried from the earth's surface to a subsurface location with a vehicle of stable foam generated at the earth's surface. See Field Demonstration Of The Conventional Steam Drive Process With Ancillary Materials, First Annual Report, October 1979–October 1980, work performed for the Department of Energy under contact DE-FCO3-79SF-10762, published April 1981 by U.S. Department of Energy.

It has also been demonstrated that the foam and the particulate material may be carried back into the formation for the purpose of propping the formation as, for instance, when foam plus particulate material are used in a formation fracturing procedure. It has further been demonstrated, as described in U.S. Pat. Nos. 4,086,864 and 3,412,793, that foam may be used to provide a temperature block in the formation to prevent steam from overriding into more permeable formations and to prevent heat from being lost into the formations above the zone of interest.

One field procedure for performing the present invention is described in U.S. patent application Ser. No. 289,550, S. O. Hutchison, filed Aug. 3, 1981 for Foam and Particulate Material with Steam for Permeability Alteration in Subsurface Formations, assigned to the same assignee as the present application. As described in that application, a conventional steam flood of a formation is accomplished with a steam injected into the formation of interest and production accumulated at a producing well spaced from the injection well. After steam has been injected for a long enough time interval to cause the crude to become mobile and to move into the producing well, it is expected that a steam breakthrough will occur into the producing well and that steam breakthrough will be evidenced by a substantial change in the volume of steam vapor produced in the producing well. It is also possible to anticipate steam breakthrough by monitoring liquid/vapor production and temperature at the producing well. When breakthrough has occurred, or before an anticipated breakthrough, a foam plus a small particulate material is injected into the formation through the zone where the crude has been swept into the producing well. The particulate material is carried with the foam into the permeability paths within the formation. The foam is then permitted to collapse and the particulate material is retained in the formation causing the permeability to be substantially blocked because of the grain size of the material carried with the foam.

Steaming of the formation may have been continuous or may then be reinitiated and continued production is developed into the producing well. On the event of another steam breakthrough, the same procedure with particulate material and foam is performed and the permeable path of the producing formation are again blocked to prevent the steam from flowing through the formation in paths not in contact or not containing petroleum crude.

The particulate material carried with the foam is preferably graded from an analysis of the actual formation involved and the particle sizes of the added material are specifically designed to accomplish the desired permeability modification in the producing formation. Samples are taken in conventional core or sidewall sampling procedures and analyses are run in conventional techniques to determine the grain sizes of the formation and the grain sizes of the particulate material to be added to the flood.

The present invention modifies the selection of materials suggested in the aforementioned copending application by selecting a particulate material from the group of materials which will provide a non-abrasive characteristic to any particulate material produced with formation fluids.

Foam quality is important to the invention here disclosed. Foam is formed by mixing together a foamable solution and a gas. The foam must be a relatively stable foam capable of carrying the material downhole. A suitable foam forming apparatus is disclosed in U.S. Pat. No. 3,603,398, Stanley O. Hutchison and John C. McKinnell, issued Sept. 7, 1971 for Method of Placing Particulate Material In An Earth Formation With Foam. That patent also disclosed suitable mechanism for combining the particulate material with the foam solution. The foam is formed by bringing a foamable solution of a surfactant and a gas together. The preferred foam is an aqueous air foam. Water and, if desired, a suitable stabilizing agent are mixed to produce a foamable solution. Suitable foam and other specific surfactants which go into the foamable solutions that make them are described in detail in U.S. Pat. No. 3,463,231 to S. O. Hutchison, et al. issued Aug. 26, 1969 for Generation And Use Of Foamed Well Circulation Fluids. The disclosure of that patent is incorporated herein by reference. A preferred foaming agent for use in this invention is a $C_{11}$ to $C_{14}$ alkyl benzene sulfonate (ABS). The ABS should be added to water to form a foamable solution in an amount of between 0.5 to 1.0 parts per weight per hundred parts water. The foamable solution is mixed with air in a gas-to-liquid volume ratio of between 3 to 50 standard cubic feet to one gallon. Superior results are obtained when the foam has a gas-liquid volume ratio between 10 to 20 standard cubic feet to one gallon.

It is preferable to form the foam with a noncondensable gas. Nitrogen is such a useful gas. Other useful gases can be natural gas and exhaust gases of a steam generator. One such possibility is the use of a downhole steam generator with the exhaust gases from that generator being used as the noncondensible gaseous material for generating the foam. It is important to the wellbore environment that the gas material used in forming the foam be noncorrosive and in that respect low in oxygen. If exhaust gases are used, it is necessary to adjust the pH of those gases in order to avoid having an acidic pH in the injection materials. It has been discovered that the injection of high pH solutions with steam can cause severe damages to the sand grains and quartz grains both in a producing formation and in a gravel pack placed in an injection or production zone.

It is also possible to damage surface and downhole well elements as well as gravel packs by the injection of abrasive particulate material. No such abrasive damage to well equipment or the crude producing formation is likely to occur with the use of the particulate material selected according to this invention.

The grain size of the particulate material added to the foam should be, as previously described, graded in accordance with the analysis of the formation materials. The material preferred in accord with the present invention, if finely divided amorphous particulate material. Such materials include graphite, carbon black, clay, quartz and other minerals reduced in size range to behave as non-abrasive amorphous materials. The material should have grain sizes in the range of 100 to 600 mesh. The preferred grading is: the particulate size range of the added particulate material should be such that the 10% size of the particulate material is between 6 and 100 times smaller than the 90% size of the formation materials. In that the added particulate materials are intended to control the permeability of the swept portion of the subsurface reservoir, it is desirable that the grain sizes of the particulate material be preferably on the small size so as to insure a proper distribution into the permeable formation. The foam will carry the particulate material into the permeable paths within the formation and, with control of the injection pressure on the foam the particulate material will be deposited as the foam collapses with the formation.

It is further important that the pressure used in injecting the foam plus particulate material is maintained below the pressure that would be expected to fracture the subsurface formation. Fracturing of the formation is not intended with the present invention, it is the control of the permeability of the formation rather than the opening of permeable paths that is desired.

During the time that the particulate material is being added into the formation, the steam injection process may continue. For that reason the foam that is formed must be able to withstand the temperature of the steam that is used in heating the subsurface formation.

In accordance with the present invention, a steam override zone in the subsurface which is caused by the opening of highly permeable paths as the heated and mobile crude is moved out of the formation can be controlled by the injection of foam containing finely divided amorphous particulate materials graded to the size of the permeability paths within the formation to control and alter the permeability paths. As alteration in a steam override permeability path can be identified in the fluids produced at a producing well as the ratio of oil and water changes from that which was observed which indicated the steam override. In that respect, a steam breakthrough is evidenced by an increase in the volume of steam vapor produced. An alteration of the permeability path accomplished in accordance with the present invention is evidenced by a decrease in the volume of steam vapor produced. Once the permeability has been altered, the injected steam will be expected to again heat the crudes within the subsurface formations to improve their mobility. If and when another steam override occurs, the formation may then again be treated with the foam plus particulate materials to accomplish another alteration of a newly developed permeability path. Continuous monitoring of the produced fluids for oil and water content and temperature can permit the present invention to be used to improve the sweep efficiency of a steam flood operation.

The invention described herein may be equally applicable to a steam flood operation using an injection well and a producing well or a single well used both for injection and for production frequently referred to as huff-and-puff. Upon the occurrence of a reduction in back pressure in the subsurface formation, it can be assumed that a permeability path has been opened in the subsurface permitting the steam to be diverted into formations where the in-place crude has already been moved. When that is observed, the formation may be foamed with the foam plus particulate material to place the particulate material in the permeability path and thus reduce the diversionary route through the formation. Further, steam injection can be followed by foam plus particulate matter, then steam again in one or more series to force steam into less permeable strata resulting in more crude produced in the production phase of huff-and-puff operation.

The improvement of the present invention is the use of finely divided amorphous particulate material that will present a non-abrasive characteristic to the oil field equipment in the injection well and in the event that the particulate material is produced from the formation during the production of formation fluids. It can be expected that the use of such particulate material will materially reduce the chances of abrasive damage to the oil field equipment if the particulate material moves with produced fluids.

The particulate material may include graphite, carbon black, clay, quartz and other minerals reduced in size range to behave as non-abrasive amorphous materials. One method of generating finely divided carbon for injection in foam is by use of a pressure burner running at less than stoichiometric oxygen rates to produce carbon black in the exhaust used as the gas phase of the injection foam.

The method of the present invention and the use of non-abrasive particulate material is applicable for permeability alteration in water floods including $CO_2$ floods and gas injection projects as well as the steam floods here described. In any of these methods the non-abrasive particulate material is introduced to accomplish permeability alteration.

While a certain preferred embodiment of the invention have been specifically disclosed, it should be understood that the invention is not limited thereto as many variations will be readily apparent to those skilled in the art and the invention is to be given its broadest possible interpretation within the terms of the following claims.

What is claimed is:

1. In a method of treating a permeable earth formation containing a petroleum crude from within a well bore penetrating said earth formation wherein a fluid is injected down said well bore and into said formation to mobilize said petroleum crude, and wherein said fluid is prepared at the earth surface and pumped down said well bore and into said formation from a position along said well bore, said fluid including finely divided amorphous particulate material adapted to be pumped with said fluid and positioned in said permeable formation as said mobilized crude moves in response to said injected fluid; the improvement comprising the steps of:

(a) a selecting said particulate material from the group consisting of graphite, carbon black, clay suspensions, quartz and other minerals reduced in size to behave as non-abrasive amorphous materials when flowing with said mobilized crude and having grain sizes in the range of 100 to 600 mesh; and (b) grading the size range of the particulate material such that the 10% size of the particulate material is between 6 and 100 times smaller than the 90% grain size of the formation materials.

2. A method of preventing abrasion damage to well pumping equipment caused by movement of plugging materials placed in the permeable portions of a subsurface formation containing said well comprising the steps of:

(a) placing said plugging materials in said formation in the form of finely divided particulate materials reduced in size to behave as non-abrasive amorphous materials and having grain sizes in the range of 100 to 600 mesh; and (b) grading the size range of the particulate material such that the 10% size of the particulate materials is between 6 and 100 times smaller than the 90% grain size of the formation materials.

3. A method of producing finely divided carbon black particulate material for use as a plugging material for placement in a subsurface earth formation with an injected fluid comprising the steps of:

(a) operating a pressure burner using a hydrocarbon fuel at less than stoichiometric oxygen rates to produce carbon black in the exhaust gases from said burner, and (b) mixing said carbon black and said exhaust gases with said injected fluid to carry said carbon black as particulate material into said formation for deposition as a plugging material.

* * * * *